US012480237B2

(12) United States Patent
Nitschke et al.

(10) Patent No.: US 12,480,237 B2
(45) **Date of Patent: *Nov. 25, 2025**

(54) MANUFACTURE OF SPUNBONDED NONWOVEN FROM CONTINUOUS FILAMENTS

(71) Applicants: Michael Nitschke, Koenigswinter (DE); Martin Neuenhofer, Roesrath (DE); Hans-Georg Geus, Niederkassel (DE); Detlef Frey, Niederkassel (DE)

(72) Inventors: Michael Nitschke, Koenigswinter (DE); Martin Neuenhofer, Roesrath (DE); Hans-Georg Geus, Niederkassel (DE); Detlef Frey, Niederkassel (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/200,610

(22) Filed: May 23, 2023

(65) Prior Publication Data

US 2023/0332342 A1 Oct. 19, 2023

Related U.S. Application Data

(62) Division of application No. 17/694,867, filed on Mar. 15, 2022, now Pat. No. 11,697,897.

(51) Int. Cl.

| | |
|---|---|
| ***D04H 1/736*** | (2012.01) |
| ***D04H 1/76*** | (2012.01) |
| ***D04H 3/077*** | (2012.01) |

(52) U.S. Cl.
CPC ..... *D04H 1/736* (2013.01); *D04H 1/76* (2013.01); *D04H 3/077* (2013.01)

(58) Field of Classification Search
CPC ..... D04H 1/736; D04H 1/76; D04H 3/077; D04H 3/16; D04H 3/033; D04H 3/11; D04H 3/005; D01D 5/088; D01D 5/092; D01D 5/0985; D01D 13/02; D01F 8/04
See application file for complete search history.

(56) References Cited

U.S. PATENT DOCUMENTS

| | | | | |
|---|---|---|---|---|
| 2,273,105 A * | 2/1942 | Heckert | D01D 5/092 425/72.2 |
| 3,320,343 A * | 5/1967 | Buschmann | D01D 5/092 425/72.1 |
| 3,672,801 A * | 6/1972 | Caldwell | D01D 5/092 425/464 |

(Continued)

*Primary Examiner* — Jeffrey M Wollschlager
(74) *Attorney, Agent, or Firm* — Andrew Wilford

(57) ABSTRACT

A spunbonded nonwovens is made by first spinning thermoplastic continuous filaments and emitting them from a spinneret in a direction and then passing the filaments in the direction through a cooling chamber. Meanwhile cooling air is fed from respective manifolds flanking the chamber into the chamber to cool the filaments and the cooling air is guided into the manifolds through respective manifolds and through respective planar homogenizing elements each having a plurality of openings forming a free open surface area constituting 1 to 40% of the total surface area of the respective planar homogenizing element. The cooling air passes from the planar homogenizing element into the cooling chamber through a flow straightener.

21 Claims, 3 Drawing Sheets

(56) References Cited

U.S. PATENT DOCUMENTS

| | | | | | |
|---|---|---|---|---|---|
| 3,907,957 | A * | 9/1975 | Shaffer | B29C 48/272 | 264/237 |
| 4,405,297 | A * | 9/1983 | Appel | D04H 3/16 | 425/72.2 |
| 4,492,557 | A * | 1/1985 | Ray | D01D 5/092 | 264/237 |
| 4,631,018 | A * | 12/1986 | Valteris | D01D 5/092 | 425/72.2 |
| 4,851,179 | A * | 7/1989 | Reifenhauser | D04H 3/16 | 264/210.8 |
| 6,379,136 | B1 * | 4/2002 | Najour | D04H 3/16 | 425/72.2 |
| 2007/0284776 | A1 * | 12/2007 | Hisada | D01D 5/088 | 425/72.2 |

* cited by examiner

MANUFACTURE OF SPUNBONDED NONWOVEN FROM CONTINUOUS FILAMENTS

CROSS-REFERENCE TO RELATED APPLICATIONS

This application is a division of U.S. patent application Ser. No. 17/694,867 filed 15 Mar. 2022 as a division of U.S. patent application Ser. No. 16/423,049 filed 27 May 2019 with a claim to the priority of EP 18 174 519.1 filed 28 May 2018.

FIELD OF THE INVENTION

The present invention relates to the manufacture of spunbonded nonwovens. More particularly this invention concerns a method and apparatus for making such nonwovens from continuous filaments.

BACKGROUND OF THE INVENTION

A known apparatus for making spunbonded nonwovens from continuous filaments, particularly from continuous filaments made of thermoplastic, has a spinneret for spinning the continuous filaments, a cooling chamber for cooling the spun filaments with cooling air, manifolds flanking the cooling chamber so that cooling air can be introduced into the cooling chamber from the oppositely situated manifolds, and at least one conduit for feeding cooling air connected to each manifold.

In the context of the invention, "spunbonded nonwoven" refers particularly to a spunbond fabric that is made by the spunbond process. Continuous filaments differ from staple fibers on account of their quasi endless length, whereas staple fibers have substantially shorter lengths of 10 mm to 60 mm, for example.

A variety of embodiments of apparatuses and methods of the type described above are inherently known from practice. However, the majority of these known apparatuses and methods have the disadvantage that the spunbonded nonwovens made with them are not always sufficiently homogeneous or uniform over their surface extension. Frequently, the spunbonded nonwovens made in this way have objectionable inhomogeneities in the form of imperfections or defects. The number of inhomogeneities usually increases as the throughput and/or yarn speed increases. Typical imperfections in such spunbonded nonwovens are caused by so-called "drops." These result from the tearing-off of one or more soft or molten filaments, resulting in a melt accumulation that creates a defect in the spunbonded nonwoven. Such imperfections due to "drops" usually have a size of greater than 2 mm×2 mm. On the other hand, imperfections in the spunbonded nonwovens can also be caused by so-called "hard pieces." These form as follows: As a result of tension loss, a filament can relax, snap back, and form a ball that creates the defect in the spunbonded nonwoven surface. Such imperfections are usually smaller than 2 mm×2 mm.

OBJECTS OF THE INVENTION

It is therefore an object of the present invention to provide an improved method and apparatus for making spunbonded nonwovens from continuous filaments.

Another object is the provision of such an improved method and apparatus that overcome the above-given disadvantages, in particular with which highly homogeneous and uniform spunbonded nonwovens that are at least largely free of imperfections or defect-free, especially at higher throughputs of greater than 200 kg/h/m and/or at higher yarn speeds.

Yet another object of the invention is to provide a corresponding method of making spunbonded nonwovens from continuous filaments.

SUMMARY OF THE INVENTION

An apparatus for making spunbonded nonwovens has according to the invention a spinneret for emitting continuous thermoplastic filaments in a filament-travel direction, a cooling chamber downstream in the direction from the spinneret for cooling the spun filaments with cooling air, two manifolds on opposite sides of the cooling chamber opening transversely of the direction into the cooling chamber, and a respective conduit having a conduit cross-sectional area and connected to each manifold for feeding cooling air thereto. The conduit cross-sectional area increases toward the manifold to a manifold cross-sectional area. The manifold cross-sectional area is at least twice as large as the conduit cross-sectional area. At least one flow straightener is provided upstream from the cooling chamber in each manifold for orienting air flow in an air-flow direction, and at least one perforated planar homogenizing element is provided in each manifold for homogenizing the cooling air flow introduced into the respective manifold upstream in the air-flow direction from the flow straightener and at a spacing from the flow straightener. The homogenizing element has a plurality of openings defining a free open surface area that is 1 to 40% of a total surface area of the homogenizing element.

A vertical height of a manifold is advantageously 400 to 1500 mm, preferably 500 to 1200 mm, and more preferably 600 to 1000 mm. One especially preferred embodiment of the invention is characterized in that the height H or the vertical height H of the manifold is between 700 and 900 mm. It lies within the scope of the invention for a manifold to be subdivided over its height H into manifold sections that are provided one above the other or vertically one above the other and will be explained below. Advantageously, apart from the height H, the above-described features as well as the preferred embodiments listed below preferably also apply to each manifold section except for the manifold.

Furthermore, it lies within the scope of the invention for the cooling air supply for the cooling chamber to be achieved through suction of the cooling air due to the filament movement and/or the downward filament flow and/or by active injection or introduction of cooling air, for example by at least one blower. If a blower is used to blow in cooling air, it is recommended that a controllable blower be used with which the volume flow of the cooling air introduced can be adjusted in particular. According to one embodiment of the invention, the blowing or introduction of cooling air is performed with a plurality of blowers.

Advantageously, the conduit cross-sectional area increases to 3 to 15 times, preferably to 4 to 15 times, and more preferably to 5 to 15 times the manifold cross-sectional area.

It also lies within the scope of the invention for at least one or more homogenizing elements to be a perforated element or perforated plate and/or as a homogenizing screen. A perforated element or perforated plate that is a homogenizing element is equipped with a plurality or multitude of holes. It is recommended that each of the holes have an opening diameter d of from 1 to 12 mm, advantageously from 1 to 10 mm, preferably from 1.5 to 9 mm, and more preferably from 1.5 to 8 mm. If a plurality of opening diameters can be measured for a hole due to its geometric configuration, the invention is referring here to the smallest opening diameter d of the hole. If the holes of a homogenizing element have different diameters, "opening diameter d" or "smallest opening diameter d" refers advantageously to the mean opening diameter d or the mean smallest opening diameter d. When a homogenizing element is a homogenizing screen, it has a plurality or a multitude of meshes. It is recommended that the homogenizing screen have mesh sizes of from 0.1 to 0.6 mm, preferably from 0.1 to 0.5 mm, more preferably from 0.12 to 0.4 mm, and very preferably from 0.15 to 0.35 mm. "Mesh size" refers here to the spacing between two opposing wires of a mesh and, particularly, to the smallest spacing between two opposing wires of a mesh. For example, if the meshes have a rectangular cross section with rectangular sides of different lengths, the mesh width between the two longer rectangular sides is measured. If the meshes of a homogenizing screen have different mesh sizes, then "mesh size" refers particularly to the mean mesh size of the meshes of the homogenizing screen. It is recommended that a homogenizing screen have a wire thickness or mean wire thickness of from 0.05 to 0.4 mm, preferably from 0.06 to 0.35 mm, and very preferably a wire thickness of from 0.07 to 0.3 mm.

Furthermore, it lies within the scope of the invention for a plurality of planar homogenizing elements in a manifold to be provided at a spacing from the flow straightener of the manifold and preferably one after the other in the air-flow direction so as to be spaced apart from one another in the manifold. At the same time, the surfaces of the planar homogenizing elements that are provided at a spacing from one another in a manifold are advantageously provided so as to be parallel to one another or substantially parallel to one another or at least approximately parallel to one another. It lies within the scope of the invention for the surfaces of the planar homogenizing elements to extend transversely to the air-flow direction in the respective manifold and, according to a preferred embodiment, to be provided so as to be perpendicular or substantially perpendicular to the air-flow direction in the manifold.

According to a recommended embodiment of the invention, the planar homogenizing element that is provided in a manifold is provided at a spacing $a_1$ in the air-flow direction upstream from the flow straightener of the corresponding manifold. The spacing $a_1$ is greater than 0 and preferably greater than 10 mm. This spacing $a_1$ is advantageously at least 50 mm, preferably at least 80 mm, and more preferably at least 100 mm. According to an especially recommended embodiment of the invention, if a plurality of planar homogenizing elements is provided in a manifold, the spacing $a_1$ refers to the homogenizing element that is provided closest upstream from the flow straightener. If the homogenizing element provided at spacing $a_1$ upstream from the flow straightener happens to be a homogenizing screen, this homogenizing screen must be distinguished from any flow screen of the flow straightener that may be present. Such a flow screen or such flow screens of the flow straightener will be discussed below.

According to a highly recommended embodiment of the invention, a plurality of homogenizing elements is provided successively in a manifold. Advantageously, the spacing $a_x$ between two homogenizing elements that are provided one after the other in a manifold in the flow direction is at least 40 mm, preferably at least 50 mm, more preferably at least 80 mm, and very preferably at least 100 mm. It has already been pointed out that, according to a trusted embodiment, the planar homogenizing elements extend transversely and, according to a recommended embodiment, perpendicular or substantially perpendicular to the air-flow direction.

According to the invention, the free open surface area of a planar homogenizing element, particularly of a perforated element or perforated plate and/or of a homogenizing screen, constitutes 1 to 40%, preferably 2 to 35%, and more preferably 2 to 30% of the total surface area of the planar homogenizing element. According to a recommended embodiment, the free open surface area of a planar homogenizing element amounts to 2 to 25%, preferably 2 to 20%, and particularly 2 to 18% of the total surface area of the planar homogenizing element. In the context of the invention, "free open surface area" refers to the surface area that can be traversed through freely by the cooling air and is thus preferably not obstructed by sheet metal elements, wire elements, or other such components. One highly recommended embodiment of the invention is characterized in that the free open surface area of the homogenizing elements that are provided successively in a manifold increases from the homogenizing element to the homogenizing element in the direction toward the flow straightener or in the direction toward the cooling chamber. Advantageously, the homogenizing element that is at the shortest spacing from the flow straightener or from the cooling chamber has the largest free open surface area of all homogenizing elements.

It lies within the scope of the invention for the surface of a homogenizing element, in particular of a perforated element or perforated plate and/or of a homogenizing screen, to extend at least over the majority of the cross-sectional area $Q_L$ of the respective manifold or over the majority of the cross-sectional area of the respective manifold section of the manifold. One trusted embodiment of the invention is characterized in that the surface of a homogenizing element extends over the entire cross-sectional area or substantially over the entire cross-sectional area of the respective manifold or the respective manifold section of the manifold.

It lies within the scope of the invention for the cooling air flowing into the manifold or into a manifold section of the manifold to be distributed to the width and the height of the manifold or of the manifold section, particularly in a uniform manner. According to a preferred embodiment of the invention, the cross-sectional area $Q_z$ of a conduit increases in a stepwise manner to the manifold cross-sectional area or to the cross-sectional area of a manifold section of the manifold. According to another recommended embodiment, the cross-sectional area $Q_z$ of a conduit increases continuously to the manifold cross-sectional area or to the cross-sectional area of a manifold section of the manifold. According to a design variant, a stepped and/or continuous enlargement of the cross-sectional area takes place along all four side walls defining the cross section of a cuboid-shaped manifold. It also lies within the scope of the invention for the cross-sectional area Q Z of a conduit to be round and preferably circular in cross section. In principle, the cross section of the conduit can be geometrical, or it can also have a different configuration, such as rectangular.

The invention is based on the discovery that, by virtue of the inventive configuration of the manifolds, optimal homogenization of the cooling air flows can be achieved and, in particular, good homogeneous cooling air distribution can be achieved in a small space. In that regard, the invention is also based on the discovery that this homogenization of the cooling air flow according to the invention affects the spun filaments in a very advantageous manner with regard to the solution of the technical problem. Finally, filament deposits or nonwoven deposits of high quality are obtained and imperfections or defects in the nonwoven deposits can be prevented or at least largely minimized. The invention is also based on the discovery that the optimal homogenization of the cooling air flow is achieved through the combination of the features according to the invention and, above all, through the combination of the homogenizing elements that are provided in the manifold on the one hand and the cross-sectional enlargement according to the invention on the other. In addition, the flow straighteners that are provided in the manifolds very effectively contribute to the homogenization of the cooling air flow. As a result of the homogenizing elements according to the invention, prealignment of the cooling air flow upstream from the flow straightener is achieved as a result of which an even more effective use of the flow straightener is apparently made possible. By virtue of the inventive design of the manifolds, turbulence in the cooling air flow can be largely avoided, and influence can also be exercised in this respect in that undesired asymmetrical air flow profiles can be prevented. As a result, optimal introduction of the air volume flows into the cooling chamber is achieved by virtue of the configuration of the manifolds. Unwanted feed errors with regard to the cooling air supply can be compensated for easily and without problems. This also applies to unwanted feed differences between the oppositely situated manifolds. In that regard, the inventive configuration of the cooler with cooling chamber and manifolds enables a "fault-tolerant construction" to be achieved. The homogenizing elements that are provided in the manifolds also fulfill the purpose of pressure consumers, so to speak. With these homogenizing elements, desired blowing profiles or cooling air speed profiles can also be adjusted in a targeted manner. It thus poses no difficulty, for example, to achieve a block profile in which the air speeds are the same or virtually the same at all points. "Bellied" and asymmetrical cooling air speed profiles are also possible.

According to a preferred embodiment of the invention, a predistribution of the cooling air is performed upon introduction of the cooling air into the manifolds, particularly upstream from the homogenizing elements. This provides upstream support for the homogenizing elements and/or pressure consumers. In this connection, flow elements in the form of wedge passages, gap passages with covers, as well as outflow pyramids and the like can be used as predistribution elements. The conduits for the cooling air can also be segmented for this purpose. Vanes of line sections in the vicinity of deflections of the conduit can also serve this purpose. In principle, the vanes in the manifold can be extended, thus resulting particularly in a segmentation of the manifold.

A preferred embodiment of the invention is characterized in that the cooling-air stream supplied to a manifold is divided into a plurality of substreams. It lies within the scope of the invention for these substreams to flow in through separate branches and/or through the segments of a split supply conduit. Furthermore, it lies within the scope of the invention for the manifold to be divided into manifold sections corresponding to the supplied substreams, in which case each manifold section is advantageously respective with a substream. According to the recommended embodiment, the cooling-air stream is divided into two to five, particularly two to four, and preferably two to three substreams. Advantageously, the air speed and/or the air temperature and/or the air humidity of each substream is set separately and suitably adapted to the respective process requirements. It is recommended that the cooling air of at least two substreams have different air speeds and/or different air temperatures and/or different air humidities. It lies within the scope of the invention for a manifold section of the manifold to open into a flow straightener for each substream of the cooling air. According to an especially preferred embodiment of the invention, a flow straightener or a continuous flow straightener is provided in all manifold sections and thus advantageously over the height or vertical height of the respective manifold.

It lies within the scope of the invention for at least one homogenizing element, preferably a plurality of homogenizing elements, to be provided in each manifold section of the manifolds. The homogenizing elements can extend continuously over the entire height of the manifold, or separate homogenizing elements can also be provided in the manifold sections. Otherwise, all of the features described here for the homogenizing elements also apply to the homogenizing elements that are provided in the individual manifold sections. It is advantageous if a plurality of homogenizing elements provided one after the other in the air-flow direction is present.

A highly recommended embodiment of the invention is characterized in that the manifold and/or each of the two oppositely situated manifolds is subdivided into at least two, preferably two, manifold sections. Cooling air of different air temperatures can preferably be fed in from these manifold sections. It lies within the scope of the invention for at least one substream of cooling air to be able to be supplied to each manifold section.

Furthermore, it lies within the scope of the invention for the air speed and/or the air volume flow at a certain height of the cooling chamber and/or of the manifolds to be uniform or substantially uniform or approximately uniform in the CD direction (transverse to the machine direction MD) over the entire width of the apparatus. However, it is possible for the cooling air speed and/or the cooling-air stream to be different over the height or the vertical height of the cooling chamber or the manifolds.

According to the invention, at least one flow straightener provided upstream from the cooling chamber in the direction of air flow is provided in each manifold. According to a preferred embodiment of the invention, each flow straightener has a plurality of flow passages that are oriented transversely, preferably perpendicular or substantially perpendicular, to the filament-travel direction or to the filament flow, the flow passages being delimited by passage walls. It is recommended that the open surface area of a flow straightener be greater than 85% and preferably greater than 90% of the total surface area or cross-sectional area of the flow straightener. It is recommended that the open surface area of a flow straightener be greater than 91%, preferably greater than 92%, and especially preferably greater than 92.5%. In this case, the open surface area of the flow straightener refers particularly to the flow cross section of the flow straightener that can be flowed through freely by the cooling air and is thus not blocked by the passage walls or the thickness of the passage walls and/or any spacers that may be provided between the flow passages or the passage walls. In particular, no flow filters provided on the flow straightener and, in particular, flow screens provided upstream or downstream from the flow straightener go into the calculation of the open area. It lies within the scope of the invention for these flow screens to be disregarded in the calculation of the open area of the flow straightener. According to a preferred embodiment, the ratio of the length L of the flow passages of a flow straightener to the inner diameter $D_i$ of the flow passages $L/D_i$ is 1 to 15, preferably 1 to 10, and more preferably 1.5 to 9. The inner diameter is measured for a flow passage of the flow straightener from a passage wall to an opposite passage wall. If it is possible to measure different inner diameters in a flow passage due to its cross-section, "inner diameter $D_i$" advantageously refers to the smallest inner diameter $D_i$ of a flow passage. This term "smallest inner diameter $D_i$" thus refers to the smallest inner diameter measured in a flow passage if this flow passage has different inner diameters with respect to its cross section. Thus, in the case of a cross section in the form of a regular hexagon, the smallest inner diameter $D_i$ is measured between two opposite sides and not between two opposite corners of the hexagon. If the smallest inner diameter varies in the flow passages, the smallest inner diameter $D_i$ refers particularly to the smallest inner diameter or mean smallest inner diameter, averaged with respect to the plurality of flow passages.

A preferred embodiment of the invention is characterized in that a flow straightener has at least one flow screen on its cooling-air intake side and/or on its cooling-air output side. The flow screen, more particularly the surface of the flow screen, is advantageously provided transverse and preferably perpendicular or substantially perpendicular to the longitudinal direction of the flow passages of the flow straightener. According to an especially recommended embodiment, a flow straightener has such a flow screen both on its cooling-air intake side and on its cooling-air output side. The flow screens are advantageously provided directly on the flow straightener without any spacing from the flow straightener. It is recommended that a flow screen have a mesh size of from 0.1 to 0.5 mm, advantageously from 0.1 to 0.4 mm, and preferably from 0.15 to 0.34 mm. "Mesh size" refers to the spacing between two opposing wires of a mesh and, particularly, to the smallest spacing between two opposing wires of a mesh. It is recommended that a flow screen have a wire thickness of from 0.1 to 0.5 mm, preferably from 0.1 to 0.4 mm, and very preferably from 0.15 to 0.34 mm. A flow screen of a flow straightener is to be distinguished from a homogenizing screen that is provided in the manifold. According to a recommended embodiment, a flow straightener has at least one flow screen, preferably two flow screens, and at least one homogenizing element and very preferably a plurality of homogenizing elements is also provided in the respective manifold.

According to the invention, the continuous filaments are emitted from a spinneret and fed to the cooling chamber in order to cool the filaments with cooling air. It lies within the scope of the invention for at least one spinning beam for spinning the filaments to be provided extending transverse to the machine direction (MD direction). According to a very preferred embodiment of the invention, the spinning beam is perpendicular or substantially perpendicular to the machine direction. It is also possible, however, and lies within the scope of the invention for the spinning beam to extend at an acute angle to the machine direction. A recommended embodiment of the invention is characterized in that at least one monomer extractor is provided between the spinneret and the cooling chamber. With this monomer extractor, air is sucked out of the filament formation region below the spinneret. This enables the gases emanating from the continuous filaments, such as monomers, oligomers, decomposition products, and the like, to be removed from the apparatus. A monomer extractor preferably has at least one extraction chamber to which the advantageous at least one extraction blower is connected. It is recommended that the cooling chamber according to the invention with the manifolds merge with the monomer extractor in the travel direction of the filaments. Advantageously, the filaments are introduced from the cooling chamber into a stretcher for elongating the filaments. It lies within the scope of the invention for an intermediate passage to extend from the cooling chamber that connects the cooling chamber to a stretch tunnel of the stretcher.

One very especially preferred embodiment of the invention is characterized in that the subassembly of the cooling chamber and the stretcher or the subassembly of the cooling chamber, the intermediate passage, and the stretch tunnel is a closed system. "Closed system" means particularly that, apart from the supply of cooling air into the cooling chamber, no further air supply takes place in this subassembly. The homogenization of the cooling air flow that is done according to the invention engenders advantages above all in such a closed system. In particular, spunbonded nonwovens are obtained that have very uniform, defect-free characteristics in such a closed system.

According to a recommended embodiment of the invention, at least one diffuser through which the filaments are guided extends from the stretcher in the travel direction of the filaments. This diffuser advantageously comprises a diffuser cross section that becomes larger in the direction of the filament placement area or a divergent diffuser section. It lies within the scope of the invention for the filaments to be deposited on a deposition device for depositing filaments or for depositing nonwovens. Advantageously, the deposition device is a mesh belt or a foraminous mesh belt. The nonwoven web formed from the filaments is conveyed away in the machine direction (MD) with the deposition device or with the mesh belt.

It is recommended that process air be aspirated or sucked from below through the deposition device or through the mesh belt in the area where the filaments are deposited. An especially stable deposition of the filament or nonwoven can thus be achieved. The extraction has especially advantageous significance in combination with the homogenization of the cooling air flow according to the invention. After deposition on the deposition device, the filament deposit or the nonwoven web is advantageously conveyed for additional treatment measures, particularly calendering.

To attain its object, the invention also teaches a method of making spunbonded nonwovens from continuous filaments, particularly from continuous filaments made of thermoplastic, where

- the continuous filaments are emitted from a spinneret and cooled in a cooling chamber with cooling air, the cooling air being introduced into the cooling chamber from manifolds that are provided on opposite sides of the cooling chamber,
- the cooling air is guided in a manifold through at least one planar homogenizing element for homogenizing the cooling air, the planar homogenizing element having a plurality of openings and the free open surface area of the planar homogenizing element constituting 1 to 40%, preferably 2 to 35% and more preferably 2 to 30% of the total surface area of the planar homogenizing element, and
- the cooling air is introduced subsequent to the planar homogenizing element into the cooling chamber, preferably through a flow straightener.

One especially preferred embodiment of the method according to the invention is characterized in that cooling air is applied to the filaments in the cooling chamber at an air speed of from 0.15 to 3 m/s, preferably from 0.15 to 2.5 m/s, and more preferably from 0.17 to 2.3 m/s. The air speed is advantageously measured (in m/s) by a vane anemometer with a diameter d of 80 mm and on a 100×100 mm grid. The air speeds are measured offline and thus without filament throughput in the cooling chamber. In this offline state, the speed vectors of the cooling air are preferably aligned perpendicular or substantially perpendicular to the longitudinal central axis of the apparatus or to the direction of filament flow FS. One recommended embodiment of the method according to the invention is characterized in that a cooling-air stream of from 200 to 14000 $m^3$/h/m, preferably from 250 to 13000 $m^3$/h/m, and more preferably from 300 to 12000 $m^3$/h/m is applied to the filaments in the cooling chamber. The expression "$m^3$/h/m" refers to the volume flow per meter of cooling chamber width. The cooling chamber width extends transversely to the machine direction and thus in the CD direction.

Below is an embodiment with typical cooling air flow parameters for an apparatus according to the invention, with two manifold sections of the two oppositely situated manifolds that are provided one above the other. Cooling air of different temperatures is supplied in the upper and in the lower manifold section. The temperature of the cooling air of two opposing manifold sections is the same. Typical parameters for manufacture of continuous filaments of polyethylene terephthalate (PET) are indicated on the one hand, and, and typical parameters for manufacture of continuous filaments of polypropylene are indicated on the other hand. For the polypropylene operation, the preferred minimum values (left column) and the preferred maximum values (right column) are also listed. The respectively specified cooling-air stream refers to the volume flow entering from the two opposing manifold sections. The vertical height of the manifold sections, the cooling-air stream, and the cooling air speed are indicated in the following tables.

| | | PET | POLYPROPYLENE (min) | POLYPROPYLENE (max) |
|---|---|---|---|---|
| Upper manifold section | | | | |
| Height | mm | 200 | 200 | 200 |
| Volume flow | $m^3$/h/m | 400 | 800 | 3000 |
| Air speed | m/s | 0.22 | 0.44 | 1.67 |
| Lower manifold section | | | | |
| Height | mm | 600 | 600 | 600 |
| Volume flow | $m^3$/h/m | 11000 | 3000 | 8000 |
| Air speed | m/s | 2.04 | 0.56 | 1.48 |

When continuous filaments are made by the method according to the invention from polypropylene (POLYPROPYLENE), the cooling air speed in the manifold or in the manifold sections of the manifold is preferably 0.25 to 1.9 m/s, advantageously 0.3 to 1.8 m/s, and preferably 0.35 to 1.7 m/s. During manufacture of continuous polypropylene filaments, the cooling-air stream is preferably 500 to 9500 $m^3$/h/m, more preferably 600 to 8300 $m^3$/h/m, and especially preferably 650 to 8100 $m^3$/h/m. When continuous filaments are made by the method according to the invention from a polyester, the cooling air speed is preferably 0.15 to 3 m/s and more preferably 0.15 to 2.5 m/s. During manufacture of continuous polyester filaments, the cooling-air stream is recommended to be 200 to 14000 $m^3$/h/m and preferably 250 to 13000 $m^3$/h/m.

According to a recommended embodiment of the invention, the same amount of air or substantially the same amount of air and thus the same cooling-air stream or substantially the same cooling-air stream is introduced from two oppositely situated manifolds or from two opposing manifold sections. It is also possible, however, for different cooling-air streams to be supplied from two oppositely situated manifolds or manifold sections. The distribution of the cooling-air streams can then be between 40 and 60% with regard to the oppositely situated manifolds or the opposing manifold sections (asymmetrical introduction of cooling air). According to another design variant, asymmetrical introduction of cooling air can also be achieved by screening off an upper region or upper regions of a manifold or a manifold section, it being possible for this screening-off to occur over up to 100 mm of the height. Moreover, asymmetrical conditions can be set up by arranging the oppositely situated manifolds or manifold sections such that they are vertically offset relative to one another. This vertical offset can be up to 100 mm. Furthermore, a lateral offset (in the CD direction) of the manifolds or manifold sections by up to 100 mm is also possible. The measures described above can also be combined with each other. It also lies within the scope of the invention for edge regions to be screened off with respect to the width of the manifold or of a manifold section in the CD direction. Introducing cooling air into the cooling chamber can thus be performed in a uniform and homogeneous manner over 85 to 90% of the CD width but set separately in the edge regions.

When filaments or spunbonded nonwovens are made according to the invention from polyolefins, particularly polypropylene, it is possible to work at yarn speeds or filament speeds of over 2000 m/min, particularly over 2200 m/min or over 2500 m/min. If filaments or spunbonded nonwovens are made from polyesters, particularly polyethylene terephthalate (PET), in the context of the invention, yarn speeds of over 4000 m/min, particularly including over 5000 m/min, can be achieved. The cited yarn speeds can be achieved, above all, without any loss of quality in the course of the measures according to the invention. It lies within the scope of the invention for the apparatus according to the invention to be configured or set up with the understanding that it is possible to work at the above-described yarn speeds. The inventive design of the manifolds has proven to be particularly useful at these high yarn speeds. According to one embodiment of the method according to the invention, throughputs of greater than 150 kg/h/m or greater than 200 kg/h/m are used.

The invention is based on the discovery that, with the apparatus according to the invention and with the method according to the invention, spunbonded nonwovens of outstanding quality can be achieved that particularly have very homogeneous characteristics over their surface extension. In the context of the invention, the spunbonded nonwovens can be made largely free of imperfections and defects, or at least imperfections and defects can be minimized to the greatest possible extent. It is particularly noteworthy in this respect that these advantages can be achieved even at the above-described high filament speeds and at high throughputs. By virtue of the inventive design of the manifolds, and due to the homogenization of the cooling air flow according to the invention, these advantageous characteristics can be achieved in the resulting spunbonded nonwovens. The invention is based on the discovery that the homogenization of the cooling air influences the filaments very positively, so that undesired imperfections or defects in the nonwoven web can be ultimately prevented or largely minimized. The homogenization of the cooling air can be achieved with measures that are relatively inexpensive and effective nonetheless. This means that the apparatus according to the invention is also characterized by little equipment setup and by cost-effectiveness. Accordingly, the method according to the invention can be carried out relatively easily and inexpensively.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
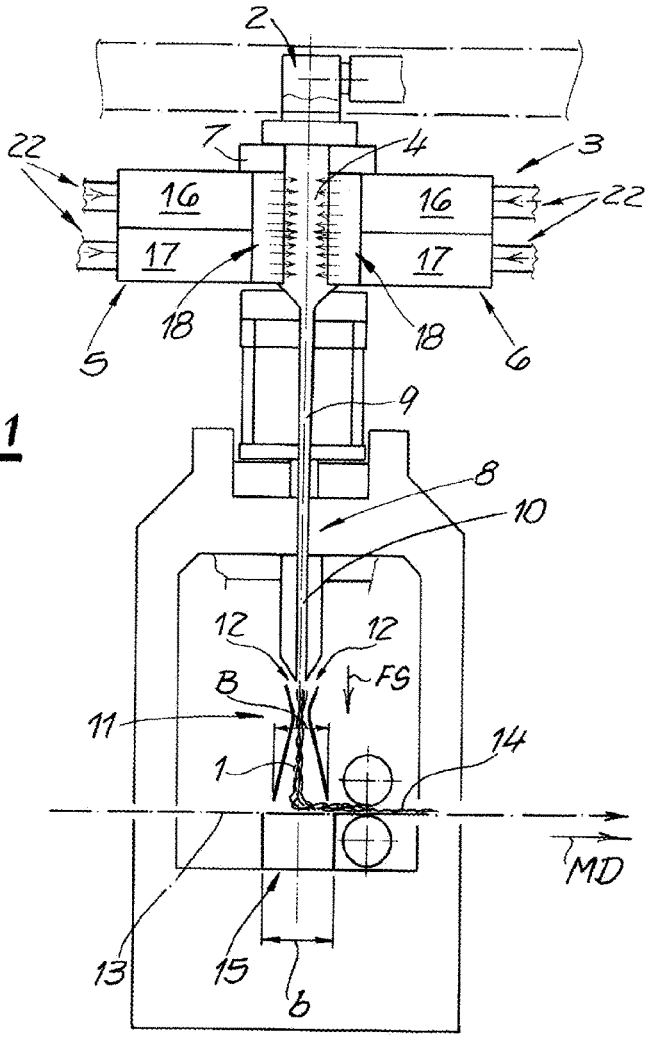
FIG. 1 is a vertical section through the apparatus according to the invention.
Figure 2:
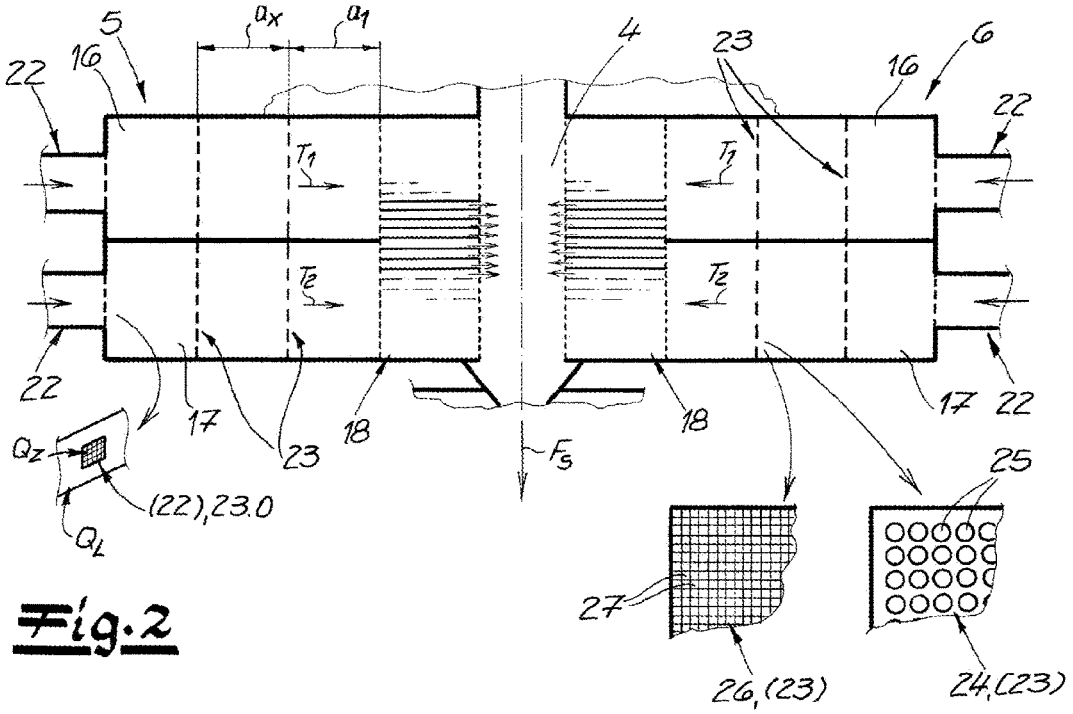
FIG. 2 is a large-scale section through a detail of FIG. 1 showing the cooler of the cooling chamber and the manifolds.

As seen in FIG. 1, an apparatus according to the invention for making spunbonded nonwovens from continuous filaments 1, particularly from continuous thermoplastic filaments 1 has a spinneret 2 for spinning the continuous filaments 1. These spun continuous filaments 1 are emitted into a cooler 3 with a cooling chamber 4 and with two manifolds 5 and 6 that are on opposite sides of the cooling chamber 4. The cooling chamber 4 and the manifolds 5 and 6 extend transversely to the machine direction MD and thus in the CD direction of the apparatus. Cooling air is fed from the oppositely situated manifolds 5 and 6 into the cooling chamber 4.

Preferably and in this embodiment, a monomer extractor 7 is provided between the spinneret 2 and the cooler 3. With this monomer extractor 7, objectionable gases generated by the spinning process can be removed from the apparatus. These gases can be monomers, oligomers, or decomposition products and similar substances, for example.

In the filament flow direction FS, the cooler 3 is followed by a stretcher 8 in which the filaments 1 are elongated. Preferably and in this embodiment, the stretcher 8 has an intermediate passage 9 that connects the cooler 3 to a stretch tunnel 10 of the stretcher 8. According to an especially preferred embodiment and in this embodiment, the subassembly of the cooler 3 and the stretcher 8 and/or the subassembly of the cooler 3, the intermediate passage 9, and the stretch tunnel 10 are a closed system. "Closed system" means particularly that, apart from the supply of cooling air into the cooler 3, no further air supply takes place in this subassembly.

Preferably and in this embodiment, a diffuser 11 through which the filaments 1 are guided extends from the stretcher 8 in the direction of filament flow FS. According to a recommended embodiment, and in this embodiment, secondary air inlet gaps 12 are provided between the stretcher 8 and/or between the stretch tunnel 10 and the diffuser 11 for introducing secondary air into the diffuser 11. Preferably and in this embodiment, after passing through the diffuser 11, the filaments are deposited on a deposition device, here a mesh belt 13. The filament deposition or the nonwoven web 14 is then conveyed or transported away by the mesh belt 13 in the machine direction MD. Advantageously and in this embodiment, an extractor for sucking air or process air through the mesh belt 13 is provided beneath the deposition device or beneath the mesh belt 13. For this purpose, an aspiration zone 15 is preferably provided beneath the mesh belt 13 and, in this embodiment, beneath the diffuser outlet. Preferably, the aspiration zone 15 extends at least over the width B of the diffuser outlet. Recommendable and in this embodiment, the width b of the aspiration zone 15 is greater than the width B of the diffuser outlet.

According to a preferred embodiment, and in this embodiment, each manifold 5 and 6 is divided into two manifold sections 16 and 17 from which cooling air of different temperatures can be fed. In this embodiment, cooling air can be supplied from each of the upper manifold sections 16 at a temperature $T_1$, whereas cooling air can be supplied from each of the two lower manifold sections 17 at a temperature $T_2$ different from the temperature $T_1$.

According to a preferred embodiment, and in this embodiment, a flow straightener 18 is provided in each manifold 5 and 6 on the cooling chamber side that, preferably and in this embodiment, extends over both manifold sections 16 and 17 of each manifold 5 and 6. The two flow straighteners 18 serve to rectify the cooling air flow incident on the filaments 1. The flow straighteners will be addressed in further detail below.

According to the invention, at least one conduit 22 for feeding the cooling air is connected to each manifold 5 and 6. These conduits 22 each have a cross-sectional area $Q_z$ that is enlarged to a cross-sectional area $Q_L$ of the manifold 5 and 6 when the cooling air passes into the manifold 5 and 6. The downstream cross-sectional area $Q_L$ is preferably at least three times as large and preferably at least four times as large as the upstream cross-sectional area $Q_z$ of the conduit 22. It lies within the scope of the invention for the cross-sectional area $Q_z$ of the conduit 22 to be increased to 3 to 15 times the cross-sectional area $Q_L$ of the manifold 5 and 6.

It also lies within the scope of the invention for at least one planar element 23 in each manifold 5 and 6 to homogenize the cooling air flow introduced into the manifolds 5 and 6. Advantageously, at least one planar homogenizing element 23 is provided in each manifold section 16 and 17 of the manifolds 5 and 6. According to an especially preferred embodiment, the homogenizing elements 23 are perforated, particularly a perforated plate 24 with a plurality of holes 25 and/or a homogenizing screen 26 with a plurality or a multitude of meshes 27. According to an especially preferred embodiment of the invention, and in this embodiment, a plurality of homogenizing elements 23 are provided successively and spaced apart from one another in each manifold 5 and 6 or in each manifold section 16 and 17 at a spacing from the flow straightener 18 in the air-flow direction. Recommendably and in this embodiment, the spacing $a_1$ between the flow straightener 18 and the homogenizing element 23 that is closest to the flow straightener 18 is at least 50 mm, preferably at least 100 mm. The mutual spacing $a_x$ between two homogenizing elements 23 that are provided successively in a manifold 5 and 6 or in a manifold section 16 and 17 in the flow direction is also at least 50 mm, preferably at least 100 mm.

According to the invention, the free open surface area of a planar homogenizing element 23 that can be flowed through freely by the cooling air constitutes 1 to 40%, preferably 2 to 35%, and more preferably 2 to 30% of the total surface area of the planar homogenizing element 23.

According to one design variant, the free open surface area of a planar homogenizing element 23 is 2 to 25%, advantageously 2 to 20%, and particularly 2 to 15%. Especially preferably and in this embodiment, the free open surface or the surface area of the successively provided homogenizing elements 23 through which the cooling air flows freely increases from homogenizing element 23 to homogenizing element 23 toward the respective flow straightener 18 or toward the cooling chamber 4. Advantageously and in this embodiment, the surface of a homogenizing element 23 also extends over the entire cross-sectional area $Q_L$ of the respective manifold 5 and 6 or of the respective manifold section 16 and 17.

Figure 3:
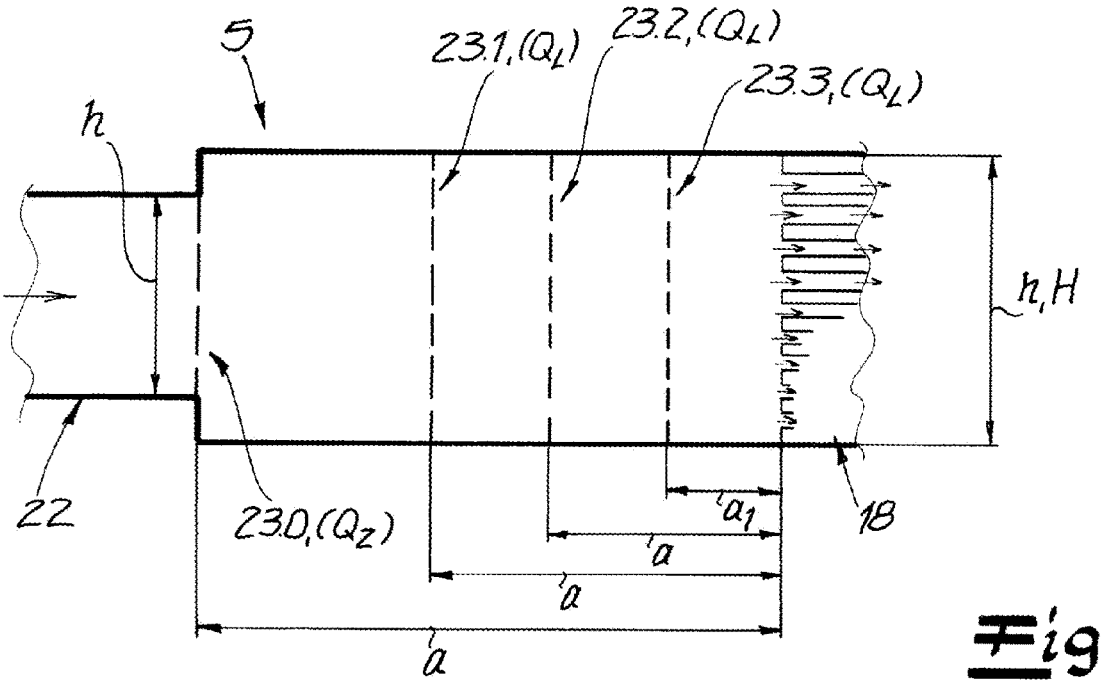
FIG. 3 is a section through a first embedment of a manifold.
Figure 4:
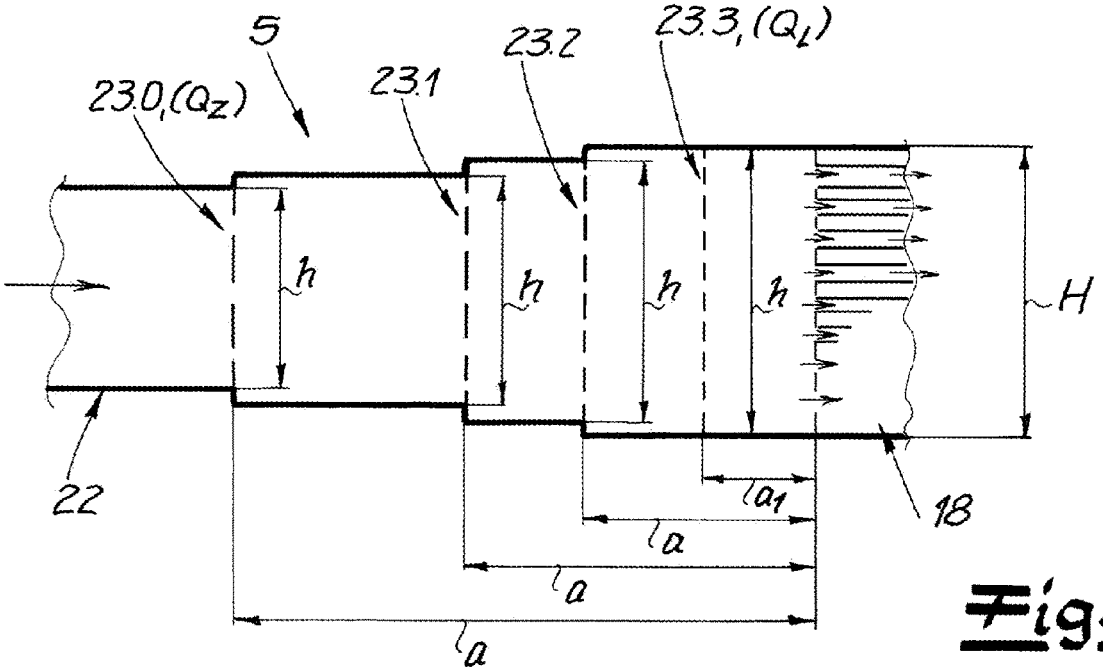
FIG. 4 is a view like FIG. 3 of a second embodiment.

Each of FIGS. 3 and 4 shows a section through a manifold 5. Instead of for an entire manifold 5 and 6, the illustration can also be used for only one manifold section 16 and 17 of the manifolds 5 and 6. In this embodiment according to FIG. 3, the upstream cross section $Q_z$ of the conduit 22 increases immediately and without gradation to the downstream cross-sectional area $Q_L$ of the manifold 5. Four homogenizing elements 23 are provided in this manifold 5 spaced in the air-flow direction upstream from the flow straightener 18. In this embodiment, the homogenizing element 23.0 is located in a transitional region between the conduit 22 and the manifold 5 and extends only over the cross section $Q_z$ of the conduit 22. The other homogenizing elements 23.1, 23.2, and 23.3 are each provided in the manifold 4 at a spacing from one another and at a spacing from the flow straightener 18. They extend over the complete cross section $Q_L$ of the manifold 5. The following table shows exemplary typical parameters for the homogenizing elements 23.0 to 23.3 according to FIG. 3, namely for a system width (in the CD direction) of 1000 mm in each case. The left column of the tables first lists the vertical height h of the homogenizing elements 23 in mm, followed by the total area of each homogenizing element 23 next to that, and the two columns to the right indicate the free open surface area, or the surface area through which the cooling air can flow freely, in percent and in $mm^2$. The relative free surface area is calculated using the following formula: Cross-sectional area of the homogenizing element×open surface area of the homogenizing element/surface area of the outflow cross section in the vicinity of the straightener. For the homogenizing elements 23.1, 23.2, and 23.3, the relative free surface area (in percent) thus coincides with the free open surface area (in percent). Just for the homogenizing element 23.0 with the cross-sectional area corresponding to the conduit 22, this yields a relative free surface area of only 1%. The spacing a (in mm) corresponds to the spacing a of the individual homogenizing elements 23 from the flow straightener 18. The integral value in the last column corresponds to the area below the curve when plotting the relative free surface area of the homogenizing elements 23 over the spacing a of these homogenizing elements 23 from the flow straightener 18.

| Element | Height H mm | Surface mm2 | Free open surface area % | mm2 | Relative free surface % | Spacing a mm | Integral |
|---|---|---|---|---|---|---|---|
| 23.0 | 350 | 350000 | 4% | 14000 | 3% | 1200 | |
| 23.1 | 500 | 500000 | 6% | 30000 | 6% | 800 | 17.6 |
| 23.2 | 500 | 500000 | 8% | 40000 | 8% | 600 | 14 |
| 23.3 | 500 | 500000 | 10% | 50000 | 10% | 400 | 18 |
| | | | Sum: | | | | 49.6 |

The height H of the manifold 5 according to FIG. 3 may be 500 mm in this embodiment, and the length 1 of the manifold 5 from the flow straightener 18 to the mouth of the conduit 22 may be 1000 mm. According to an especially preferred embodiment of the invention, the sum of the integral values explained above is greater than 45, preferably greater than 50, and more preferably greater than 65.

FIG. 4 shows a second embodiment of a manifold 5 according to the invention. Here as well, four homogenizing elements 23.0 to 23.3 are used. In contrast to the embodiment according to FIG. 3, however, stepped enlargement of the cross section $Q_z$ of the conduit 22 to the total cross section $Q_L$ of the manifold 5 takes place here. This stepped expansion advantageously takes place in a cuboid-shaped manifold 5 over all four walls toward the flow straightener 18. Apart from the differences due to the stepped cross-sectional enlargement, the dimensions in this embodiment according to FIG. 4 correspond to the dimensions in this embodiment according to FIG. 3. Analogously to the table in relation to FIG. 3, the parameters for the embodiment of FIG. 4 are listed in the following table:

| Element | Height H mm | Surface mm2 | Free open surface area % | mm2 | Relative free surface % | Spacing a mm | Integral |
|---|---|---|---|---|---|---|---|
| 23.0 | 350 | 300000 | 3% | 9000 | 2% | 1000 | |
| 23.1 | 400 | 400000 | 6% | 24000 | 5% | 800 | 6.6 |
| 23.2 | 450 | 450000 | 8% | 36000 | 7% | 600 | 12 |
| 23.3 | 500 | 500000 | 10% | 50000 | 12% | 300 | 28.8 |
| | | | Sum: | | | | 47.4 |

Figure 5:
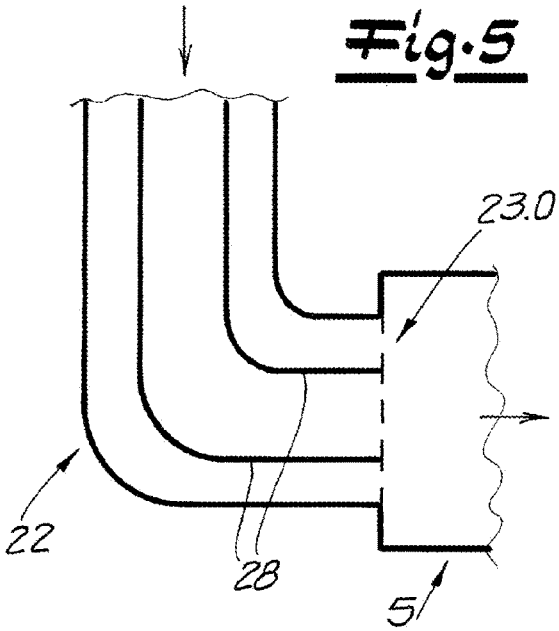
FIG. 5 is a section through a split supply conduit with connected manifold.

FIG. 5 illustrates the connection region of a curved conduit 22 to the manifold 5. According to this embodiment, segmentation elements 28 are provided in the conduit 22 that split the conduit 22 into individual line segments. By virtue of this segmentation or vaning of the conduit section, an additional equalization of the cooling air flow can be achieved. In particular, the cooling air flow here is subjected here to a pre equalization and is thus prepared for further equalization or homogenization in the manifold 5.

Figure 7:
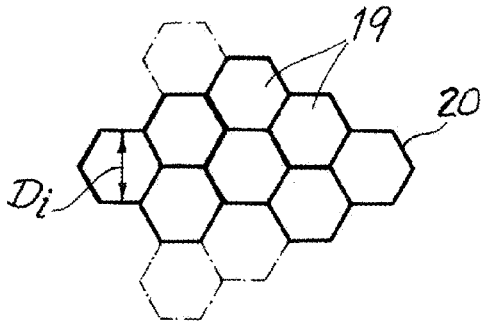
FIG. 7 is a cross section through part of a flow straightener.
Figure 6:
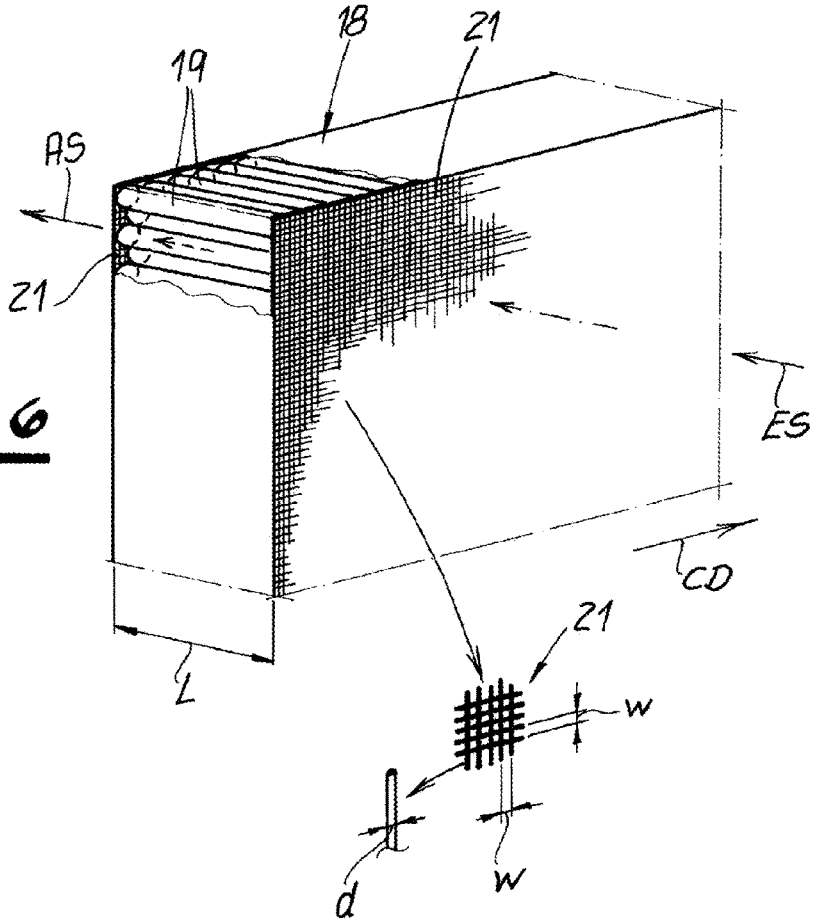
FIG. 6 is a perspective view of a subassembly of a flow straightener with upstream and downstream flow screens.

FIG. 6 shows a perspective view of a flow straightener 18 that is preferably used in the context of the invention. The flow straighteners 18 serve to rectify the cooling air flow that is incident on the filaments 1. Recommendably and in this embodiment, each flow straightener 18 has a plurality of flow passages 19 for this purpose that are oriented perpendicular to the direction of filament flow FS. These flow passages 19 are each delimited by passage walls 20 and are preferably straight. According to a preferred embodiment, and in this embodiment, the free or open surface area of each flow straightener 18 constitutes greater than 90% of the total area of the flow straightener 18. Advantageously and in this embodiment, the ratio of the length L of the flow passages 19 to the smallest inner diameter $D_i$ of the flow passages 19 lies in the range between 1 and 10, advantageously in the range between 1 and 9. As an example, and in this embodiment according to FIG. 7, the flow passages 19 of a flow straightener 18 can have a hexagonal or honeycomb-shaped cross section. The smallest inner diameter $D_i$ is measured here between opposite sides of the hexagon.

According to a preferred embodiment, and in this embodiment, each flow straightener 18 has a flow screen 21 both on its cooling-air intake side ES and on its cooling-air output side AS. Preferably and in this embodiment, the two flow screens 21 of each flow straightener 18 are provided directly in front of or behind the flow straightener 18. In that regard, the flow screens 21 are to be distinguished from the homogenizing elements 23 that are homogenizing screens 26. Recommendably and in this embodiment, the two flow screens 21 of a flow straightener 18, more particularly the surfaces of these flow screens 21 are aligned perpendicular to the longitudinal direction of the flow passages 19 of the flow straightener 18. It has proven advantageous for the flow screen 21 to have mesh sizes of from 0.1 to 0.5 mm and preferably from 0.1 to 0.4 mm, as well as a wire thickness of from 0.05 to 0.35 and preferably from 0.05 to 0.32

We claim:

1. A method of making spunbonded nonwovens comprising the steps of:

spinning thermoplastic continuous filaments and emitting them from a spinneret in a filament direction and at a filament speed;

passing the filaments in the filament direction through a cooling chamber;

feeding flows of cooling air from respective manifolds oppositely flanking the chamber into the chamber to cool the filaments;

setting the flows from the manifolds asymmetrically; and guiding the cooling air in the manifolds through respective planar homogenizing elements each having a plurality of openings forming a free open surface area constituting 1 to 40% of a total surface area of the respective planar homogenizing element, and then through respective flow straighteners into the cooling chamber.

2. The method defined in claim 1, wherein the cooling air is applied in the chamber to the filaments at an air speed of from 0.15 to 3 m/s.

3. The method defined in claim 1, wherein the cooling air is fed into the chamber from the manifolds to the filaments in the cooling chamber in streams at a rate of from 200 to 14000 $m^3$/h/m.

4. The method defined in claim 1, wherein the manifolds each have a vertical height of from 400 to 1500 mm.

5. The method defined in claim 1, further comprising the step of:

supplying the cooling air to the manifolds as a plurality of substreams from respective conduits.

6. The method defined in claim 1, further comprising the steps of:

subdividing the cooling-air stream into two to five substreams.

7. The method defined in claim 5, further comprising the step of:

imparting to the cooling air of at least two of the substreams respective different air speeds or different temperatures or different humidities.

8. The method defined in claim 1, further comprising the step of:

subdividing each manifold into at least two manifold sections from which cooling air of different temperatures is supplied as two respective substreams.

9. The method defined in claim 1, wherein a free open surface area of each of the homogenizing elements that are provided one after the other increases in an air-flow direction toward the respective flow straightener.

10. The method defined in claim 1, wherein a surface area of each homogenizing element extends over at least half of a manifold cross-sectional area of the respective manifold.

11. The method defined in claim 5, wherein a cross-sectional area of each conduit increases stepwise in a plurality of stages or continuously in an air-flow direction to the respective manifold.

12. The method defined in claim 5, further comprising the step of:

homogenizing flow of the cooling air into the manifolds with predistribution elements in the conduits upstream of the manifolds.

13. The method defined in claim 12, wherein the predistribution elements are wedge-shaped passages, gap passages with covers, or outflow pyramids.

14. The method defined in claim 1, wherein the flows of the cooling air are set asymmetrically by partially screening flow through one of the manifolds.

15. The method defined in claim 14, wherein only the upper 100 mm of an output end of the one manifold are partially screened off.

16. The method defined in claim 1, wherein the flows are set asymmetrically by vertically or horizontally offsetting an outlet end of one of the manifolds relative to an outlet end of the other manifold.

17. The method defined in claim 16, wherein the outlet end of the one manifold is offset vertically or horizontally by at most 100 mm from the outlet end of the other manifold.

18. The method defined in claim 1, wherein the flows of the cooling air are set asymmetrically by varying the flows of the cooling air from at least one of the manifolds relative to the flow from an outlet end of the other manifold.

19. The method defined in claim 1, wherein the filaments are of polypropylene and/or polyethylene terephthalate and the filament speed is at least 2000 m/min.

20. The method defined in claim 1, wherein the filaments are of polyethylene terephthalate and the filament speed is at least 4000 m/min.

21. A method of making spunbonded nonwovens comprising the steps of:

spinning thermoplastic continuous filaments and emitting them from a spinneret in a filament direction and at a filament speed;

passing the filaments in the filament direction through a cooling chamber;

feeding flows of cooling air from respective manifolds oppositely flanking the chamber into the chamber to cool the filaments; and setting the flows from the manifolds asymmetrically while simultaneously guiding the cooling air in the manifolds through respective planar homogenizing elements each having a plurality of openings forming a free open surface area constituting 1 to 40% of a total surface area of the respective planar homogenizing element, then through upstream flow screens on intake sides of respective flow straighteners, then through the straighteners and finally out of the straighteners through downstream flow screens on output sides of the flow straighteners into the cooling chamber.

* * * * *